US008777402B2

(12) United States Patent
Koichi

(10) Patent No.: US 8,777,402 B2
(45) Date of Patent: Jul. 15, 2014

(54) INKJET RECORDING DEVICE AND METHOD OF RELEASING COVER LOCK OF INKJET RECORDING DEVICE

(71) Applicant: Hiroshi Koichi, Kanagawa (JP)

(72) Inventor: Hiroshi Koichi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/848,124

(22) Filed: Mar. 21, 2013

(65) Prior Publication Data

US 2013/0250013 A1 Sep. 26, 2013

(30) Foreign Application Priority Data

Mar. 22, 2012 (JP) ..... 2012-065475

(51) Int. Cl.
*B41J 29/13* (2006.01)

(52) U.S. Cl.
USPC ..... 347/108

(58) Field of Classification Search
USPC ..... 347/5, 9, 23, 108; 361/730, 732, 752; 400/691–693
See application file for complete search history.

(56) References Cited

U.S. PATENT DOCUMENTS 6,065,831 A * 5/2000 Kawaura et al. ..... 347/108
6,969,169 B2 * 11/2005 Tanaami et al. ..... 347/108
7,334,861 B2 * 2/2008 Ha ..... 347/19

FOREIGN PATENT DOCUMENTS

JP 2006-142608 6/2006
JP 2007-098914 4/2007

* cited by examiner

*Primary Examiner* — Ahn T. N. Vo
(74) *Attorney, Agent, or Firm* — Harness, Dickey & Pierce, P.L.C.

(57) ABSTRACT

An inkjet recording device includes a carriage including a print head for firing ink droplets onto a recording medium from a nozzle; a carriage driving unit configured to drive the carriage; an openable cover configured to cover a moving area of the carriage; a cover lock member configured to lock the cover to a housing; a lock control unit configured to control lock and release of the lock of the cover by the cover lock member; a lock releasing unit configured to request the lock control unit to release the lock; and a carriage power control unit configured to control opening and closing of a power supplying path to the carriage driving unit. The lock control unit causes the cover lock member to release the lock if the lock releasing unit is operated and the carriage power control unit opens the power supplying path to the carriage driving unit.

11 Claims, 7 Drawing Sheets

INKJET RECORDING DEVICE AND METHOD OF RELEASING COVER LOCK OF INKJET RECORDING DEVICE

CROSS-REFERENCE TO RELATED APPLICATION

The present application claims priority to and incorporates by reference the entire contents of Japanese Patent Application No. 2012-065475 filed in Japan on Mar. 22, 2012.

BACKGROUND OF THE INVENTION

1. Field of the Invention

The present invention relates to an inkjet recording device, and a method of releasing a cover lock of the inkjet recording device.

2. Description of the Related Art

When a recording sheet gets jammed or a carriage operation error occurs in an inkjet recording device, an operator opens a cover and inserts a hand to remove the recording sheet, or moves a carriage to its home position. If the carriage is moved then, it can hit a hand of the operator or the operator can get his/her finger caught therein, which is significantly dangerous. If the carriage keeps printing operation when the cover is opened during printing, the operator may touch the carriage with his/her hand unintentionally, which is significantly dangerous.

Then, it is already known that the movement of a carriage is stopped in response to the detection of opening of a cover at the moment when the cover is opened, in order to avoid the danger.

Moreover, it is also already known that a cover and a housing are locked so that an operator cannot open the cover until printing is finished or an error is detected.

However, the conventional inkjet recording device does not necessarily guarantee the safety because there occurs a time difference between the detection of opening of a cover and the stop of a carriage, depending on detection timing, etc. There is a possibility of failure or malfunction, and the carriage is not necessarily stopped. Therefore, the safety is not sufficient. Even if the cover and the housing are locked, it is possible that when the lock is released and the cover is opened, the carriage is moved due to malfunction of the carriage. In the case where the carriage is stopped in the center of the housing when an error is detected, the carriage is possibly moved when the cover is opened and a hand is inserted in the housing, which can be a problem in terms of safety.

Japanese Patent Application Laid-open No. 2006-142608 discloses a printer and a printing control method. The printer includes an openable cover that covers a moving area of a printing head, a cover state detecting unit that detects the opening and closing of the cover, a printing state detecting unit that detects a printing state, and a lock unit that locks the cover to a housing. For the safe operation of an operator, the cover is locked to the housing during printing operation so that the cover is prevented from being opened, and the lock is released when printing is finished or an error is detected so that the cover can be opened.

According to the conventional technique as described above, the cover is locked to the housing so that the cover cannot be opened during printing operation. However, in the conventional technique, the carriage is possibly moved due to malfunction of the carriage when the lock is released and the cover is opened. Moreover, in the case where the carriage is stopped in the center of the housing when an error is detected, the carriage is possibly moved when the cover is opened and a hand is inserted in the housing. Thus, the problems regarding the safety have not been solved sufficiently.

Therefore, there is a need to provide an inkjet recording device that is excellent in safety and allows an operator to use it safely without a risk of injury due to the movement of the carriage.

SUMMARY OF THE INVENTION

It is an object of the present invention to at least partially solve the problems in the conventional technology.

According to an embodiment, there is provided an inkjet recording device that includes a carriage including a print head for recording by firing an ink droplet onto a recording medium from a nozzle; a carriage driving unit configured to drive the carriage; an openable cover configured to cover a moving area of the carriage; a cover lock member configured to lock the cover to a housing of the inkjet recording device; a lock control unit configured to control lock of the cover and release of the lock of the cover by the cover lock member; a lock releasing unit configured to request the lock control unit to release the lock of the cover; and a carriage power control unit configured to control opening and closing of a power supplying path to the carriage driving unit. The lock control unit causes the cover lock member to release the lock of the cover if the lock releasing unit is operated and the carriage power control unit opens the power supplying path to the carriage driving unit.

According to another embodiment, there is provided a method of releasing a cover lock of an inkjet recording device that includes a carriage including a print head for recording by firing an ink droplet onto a recording medium from a nozzle, a carriage driving unit configured to drive the carriage, an openable cover configured to cover a moving area of the carriage, a cover lock member configured to lock the cover to a housing of the inkjet recording device, a lock control unit configured to control lock of the cover and release of the lock of the cover by the cover lock member, a lock releasing unit configured to request the lock control unit to release the lock of the cover, and a carriage power control unit configured to control opening and closing of a power supplying path to the carriage driving unit. The method includes causing, by the lock control unit, the cover lock member to release the lock of the cover if the lock releasing unit is operated and the carriage power control unit opens the power supplying path to the carriage driving unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8 is a flowchart illustrating control procedures the system control unit when a power supply is turned on.

DETAILED DESCRIPTION OF THE PREFERRED EMBODIMENTS

An embodiment of an inkjet recording device of the invention is described with reference to the accompanying drawings.

Figure 1:
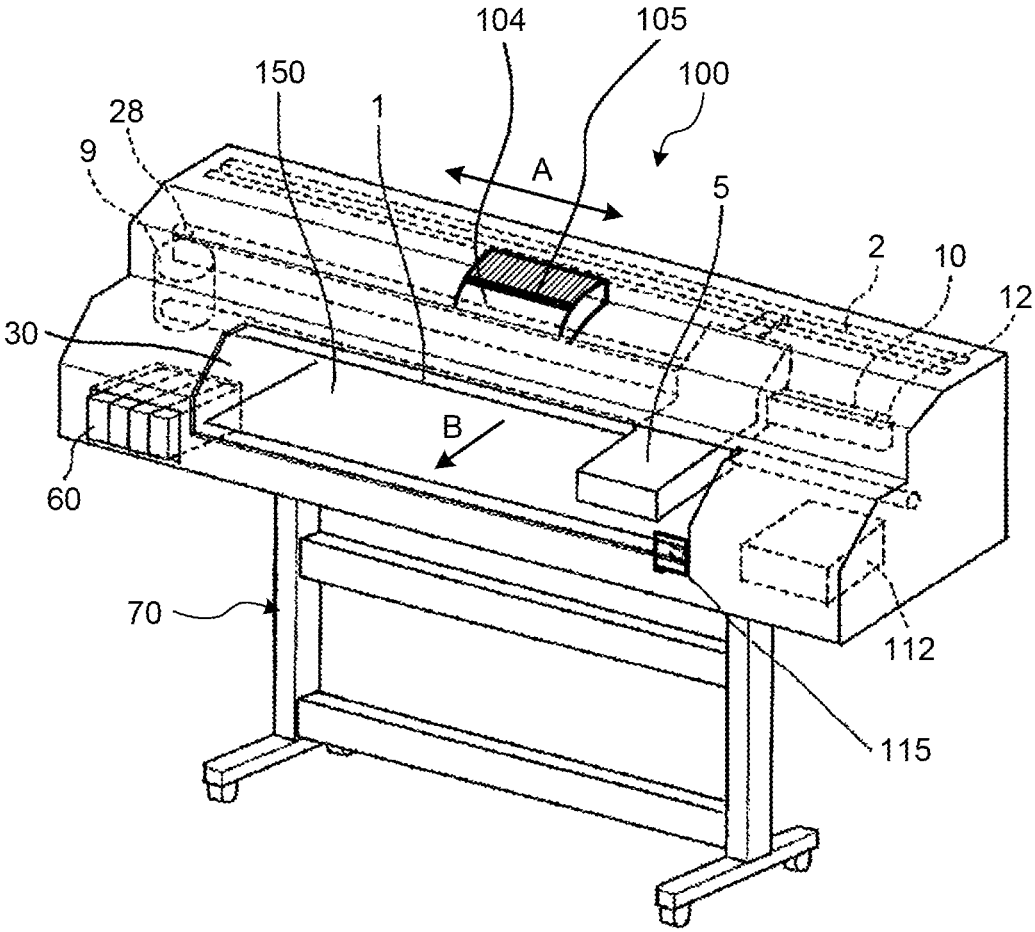
FIG. 1 is a diagram schematically illustrating an entire configuration of an inkjet recording device.

FIG. 1 is a diagram schematically illustrating an entire configuration of the inkjet recording device of the embodiment of the present invention.

The inkjet recording device of the embodiment is what is called a serial inkjet recording device that performs recording while reciprocating a print head in a main-scanning direction. As illustrated in FIG. 1, the inkjet recording device includes a recording device 100 and a body frame 70 supporting the recording device 100. A guide rod 1 and a width guide 2 are extended over in the recording device 100, and a carriage 5 is supported by the guide rod 1 and the width guide 2 so that it can move in the direction of the arrow A (main-scanning direction). The carriage 5 is connected to a timing belt 10, and reciprocated in a main-scanning direction A when the timing belt 10 is driven by a main-scanning motor 9 and a driving pulley 28.

A pressing roller 12 applies a tensile force on the timing belt 10, which makes it possible to drive the carriage 5 without loosening of the timing belt 10. A printing medium (recording sheet, for example) 150 is conveyed intermittently to the direction of the arrow B (sub-scanning direction) under the reciprocating carriage 5, and ink is fired from a nozzle of a print head provided in the carriage 5 to form a given image.

The recording device 100 includes a cartridge 60 supplying ink and a maintenance mechanism 112 (service station) for cleaning the print head. The maintenance mechanism 112 includes a cap that covers an ink-firing port formation face (the tip of the nozzle) of the print head while the print head is not in operation, thus protecting the print head with the cap.

The carriage 5 is equipped with an encoder sensor therein. Scanning an encoder sheet extended in a main-scanning direction, the carriage 5 moves while detecting positions in the main-scanning direction.

An operating unit 104 includes various operation keys operated by an operator. A cover lock releasing button as a lock releasing unit, which is described later, is arranged on the operating unit 104. A display unit 105 displays an operation method of the inkjet recording device or an operation state thereof, for example. Alternatively, the display unit 105 is capable of one or plural kinds of display among various display such as visual display and audio display of a message to an operator.

A cover 30 is provided to cover a moving area of the carriage 5 (the cover 30 is not limited to one covering only the moving area) so that an operator cannot insert his/her hand into the inkjet recording device recklessly, and is opened and closed by an operator. A cover lock unit 115 locks the cover 30 to the body housing by a cover lock member 122 (see FIG. 5), so that an operator cannot open the cover 30.

Figure 2:
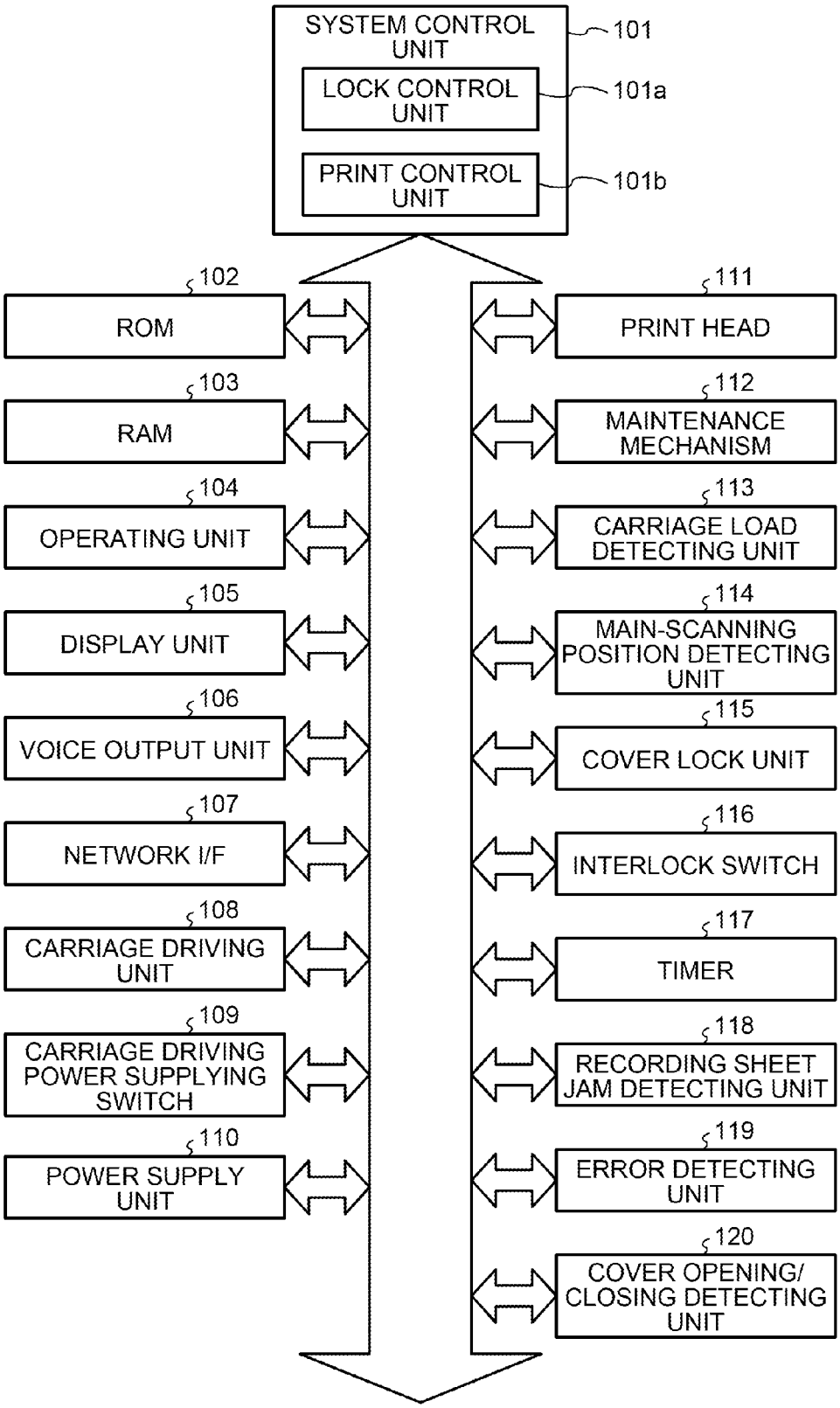
FIG. 2 is a block diagram illustrating a system configuration of the inkjet recording device.

FIG. 2 is a block diagram illustrating a system configuration of the inkjet recording device.

In FIG. 2, a system control unit 101 includes a central processing unit (CPU), etc., and performs given operation while controlling each unit of the inkjet recording device based on a basic program for the operation of the inkjet recording device.

A read-only memory (ROM) 102 stores the basic program for the operation of the inkjet recording device.

A random-access memory (RAM) 103 stores various pieces of information unique to the inkjet recording device.

The operating unit 104 includes various operation keys operated by an operator. The display unit 105 displays an operation method of the inkjet recording device or an operation state thereof, or displays a message, etc., to an operator.

A voice output unit 106 outputs by voice a message to an operator, that is, displays the message by voice.

A network interface (I/F) 107 is an interface that includes an interface function for the connection to a network.

A carriage driving unit 108 includes a main-scanning motor 9 that drives the carriage 5 to a main-scanning direction and a driver (not illustrated) outputting signals to the main scanning motor 9. Therefore, the main-scanning motor 9 stops the drive when the power supply to the main-scanning motor 9 or the driver is turned off.

A carriage driving power supplying switch 109 is turned on and off to close and open a power supplying path to the carriage driving unit 108. When the carriage driving power supplying switch 109 is turned off, the power supplying path to the carriage driving unit 108 is opened, thus cutting off the electric power supply to the carriage driving unit 108.

A power supply unit 110 supplies power input from an external commercial power supply to each unit of the inkjet recording device.

The print head 111 fires ink onto a recording sheet to form a given image thereon.

The maintenance mechanism 112 includes a cap that covers an ink-firing port formation face of the print head 111 while the print head 111 is not in operation, thus protecting the print head 111.

A carriage load detecting unit 113 detects a load when the carriage 5 is moved in a main-scanning direction. When the load detected is large, the carriage load detecting unit 113 determines that some obstacle exists, and stops the movement of the carriage 5.

The main-scanning position detecting unit 114 detects a position in a main-scanning direction of the print head 111.

The cover lock unit 115 locks, by the cover lock member 122, the cover 30 to the main housing so that the cover 30 cannot be opened.

The interlock switch 116 is a switch that is turned on and off in association with the opening and closing of the cover. When the interlock switch 116 is turned off, the power supplying path to the carriage driving unit 108 is opened, thus cutting off the power supply to the carriage driving unit 108.

A timer 117 counts (measures) time of given operation.

A recording sheet jam detecting unit 118 detects a jam of a recording sheet moving in a sub-scanning direction.

An error detecting unit 119 detects that the inkjet recording device does not operate normally.

A cover opening/closing detecting unit 120 detects the opening and closing of the cover.

The system control unit 101 performs given operation while controlling each unit of the inkjet recording device. Here, the system control unit 101 as a whole may perform entire control. Alternatively, the system control unit 101 may be composed of a plurality of individual control elements to perform specific control.

In the description here, the system control unit 101 includes a lock control unit 101*a* for controlling the cover lock unit 115 (cover lock member 122), and a carriage power control unit 101*b* as a control element that performs control such as control of carriage driving power supply and other power supply, carriage driving control, control of the display unit, etc.

The control elements may be formed integrally with the system control unit 101, or may be formed as separate control elements constituting the system control unit as a whole.

Figure 3:
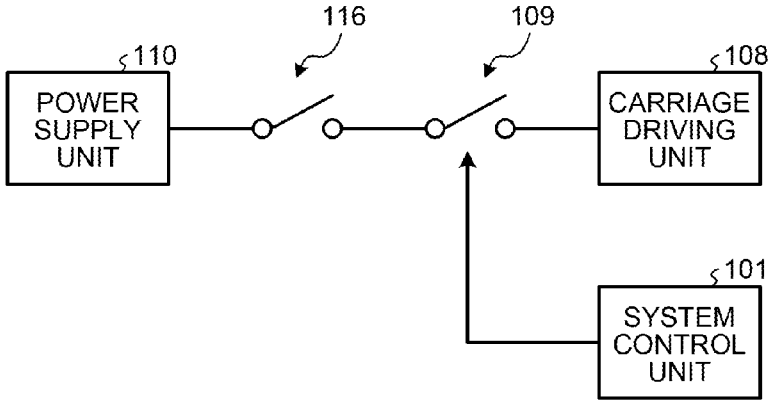
FIG. 3 is a circuit diagram illustrating a circuit for power supply to a carriage driving unit.

FIG. 3 is a circuit diagram illustrating a circuit for power supply to the carriage driving unit 108.

The carriage driving unit 108 receives power for driving the carriage from the power supply unit 110, as illustrate in FIG. 3. Here, the interlock switch 116 is a switch that is turned off when the cover 30 is opened and turned on when the cover 30 is closed. The carriage driving power supplying switch 109 is turned on and off by control of the carriage power control unit 101*b* of the system control unit 101. Only when both of the switches 116 and 109 are turned on, the power supplying path to the carriage driving unit 108 is closed, and the power is supplied to the carriage driving unit 108.

Figure 4:
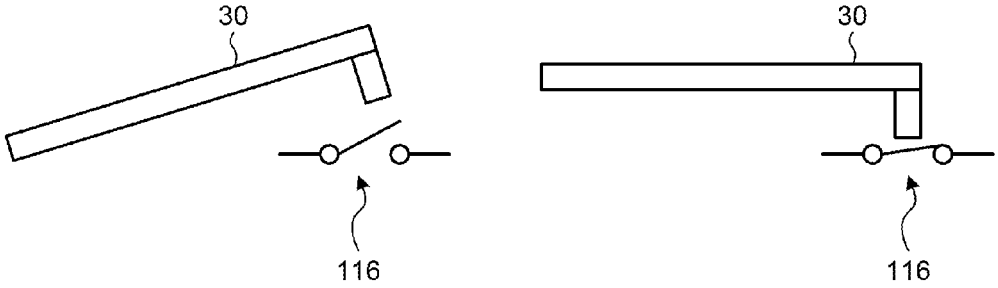
FIG. 4 is a diagram illustrating an interlock switch.

FIG. 4 is a diagram illustrating the interlock switch 116.

As illustrated in FIG. 4, the interlock switch 116 is turned off when the cover 30 is opened, and the interlock switch 116 is turned on when the cover 30 is closed. In this manner, the interlock switch 116 is turned on and off in association with the movement of the cover 30.

Figure 5:
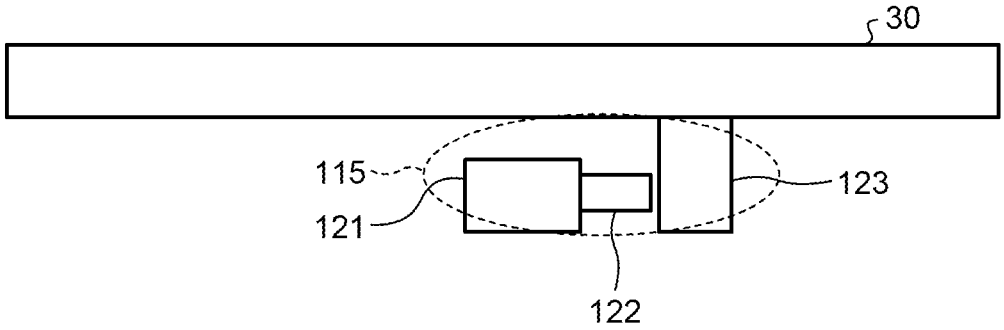
FIG. 5 is a diagram schematically illustrating an entire configuration of a cover lock unit.

FIG. 5 is a diagram schematically illustrating an entire configuration of the cover lock unit 115.

A hook member 123 is attached on the inner side of the cover 30. A solenoid 121 and the lock member 122 are attached in the main housing.

When the cover 30 is closed, the hook member 123 is moved to a given position in the inner side of the cover 30. Here, the hook member 123, the solenoid 121, and the lock member 122 are collectively referred to as the cover lock unit 115.

The solenoid 121 is controlled by the lock control unit 101*a* of the system control unit 101 so as to move the lock member 122. The lock member 122 latches the hook member 123 moved to a given position, which locks the cover 30 to the main housing, thus preventing the cover 30 from being opened. When a main power supply (not illustrated) of the inkjet recording device is turned off, the solenoid 121 moves the lock member 122 to a direction for releasing the lock, thus avoiding the cover 30 from remaining locked.

Figure 6:
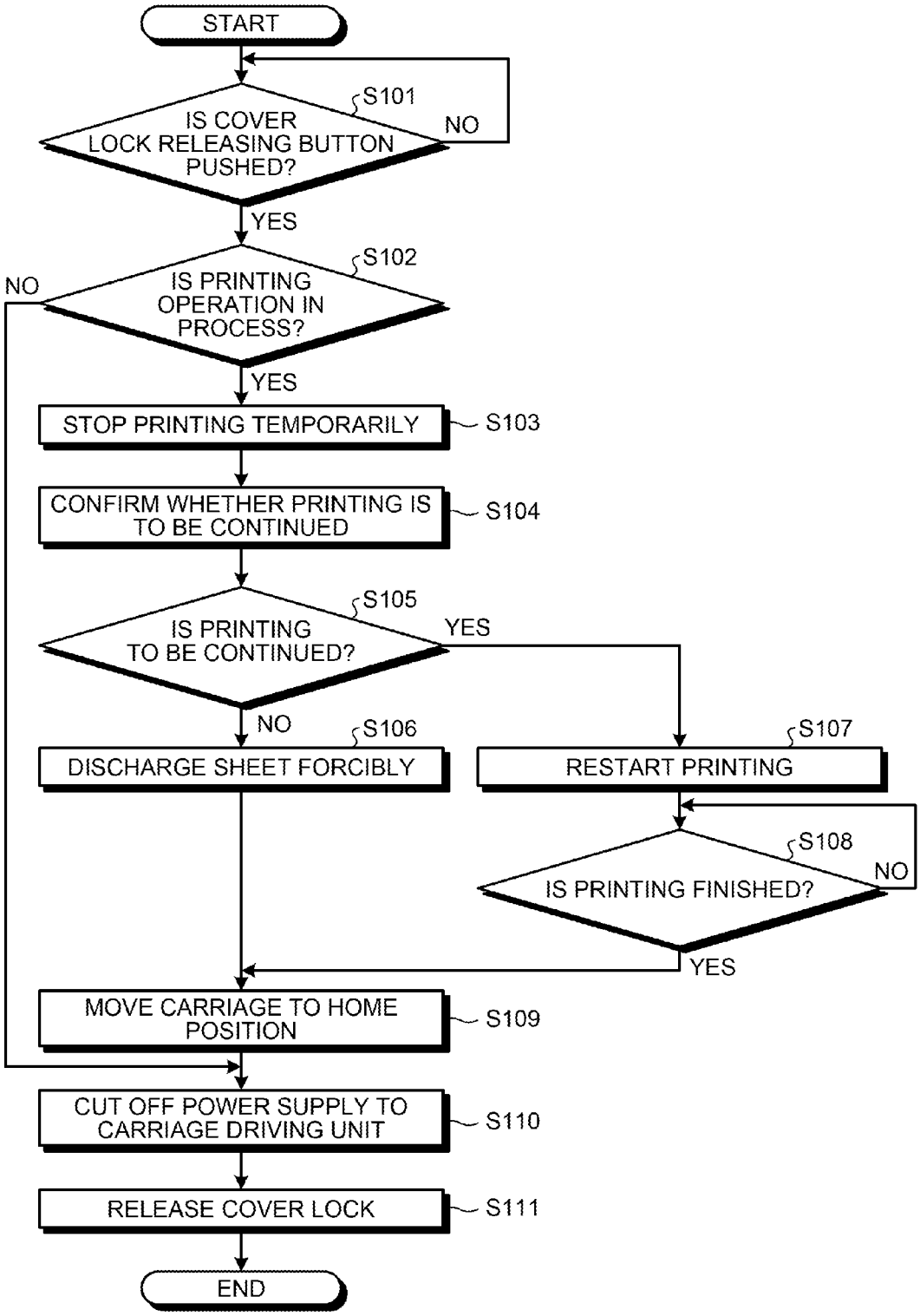
FIG. 6 is a flowchart illustrating control procedures in a system control unit when a cover lock releasing button is pushed while a cover is locked.

FIG. 6 is a flowchart illustrating control procedures by the system control unit 101 when the lock releasing unit requests the release of cover lock while the cover 30 is locked, concretely when a "cover lock releasing button" of the operating unit 104 is pushed.

The control procedures when the cover lock releasing button of the operating unit 104 is pushed are described with reference to FIG. 6.

When the carriage power control unit 101*b* of the system control unit 101 detects that the cover lock releasing button of the operating unit 104 is pushed (Yes at Step S101), it then determines whether the printing operation is in process (Step S102). If the printing operation is in process (Yes at Step S102), the carriage power control unit 101*b* stops printing temporarily (Step S103), and displays, on the display unit 105, an indication prompting a user to instruct whether the printing is to be continued (Step S104). Here, when the operator instructs "the printing is not to be continued" (No at Step S105), the carriage power control unit 101*b* forcibly discharges a recording sheet in printing process (Step S106), and moves the carriage 5 to its home position at which there is the maintenance mechanism 112 (Step S109).

When the operator instructs "the printing is to be continued" (Yes at Step S105) at Step S105, the carriage power control unit 101*b* restarts printing (Step S107) that is stopped temporarily at Step S103, and moves the carriage 5 to its home position (Step S109) once it confirms that the printing is finished (Yes at Step S108).

Thereafter, the carriage power control unit 101*b* turns off the carriage driving power supplying switch 109 to open the power supplying path to the carriage driving unit 108, and thus cutting off the power supply to the carriage driving unit 108 (Step S110). After the carriage 5 stops operating, the lock control unit 101*a* releases the lock of the cover 30 by the cover lock unit 115 (Step S111) so that the cover 30 can be opened, and finishes the sequence of processing.

If the printing operation is not in process (No at Step S102) when the cover lock releasing button is pushed at Step S102, the carriage power control unit 101*b* immediately turns off the carriage driving power supplying switch 109 to open the power supplying path to the carriage driving unit 108, thus cutting off the power supply to the carriage driving unit 108 (Step S110). Subsequently, the lock control unit 101*a* releases the lock of the cover 30 by the cover lock unit 115 (Step S111) so that the cover 30 can be opened.

Figure 7:
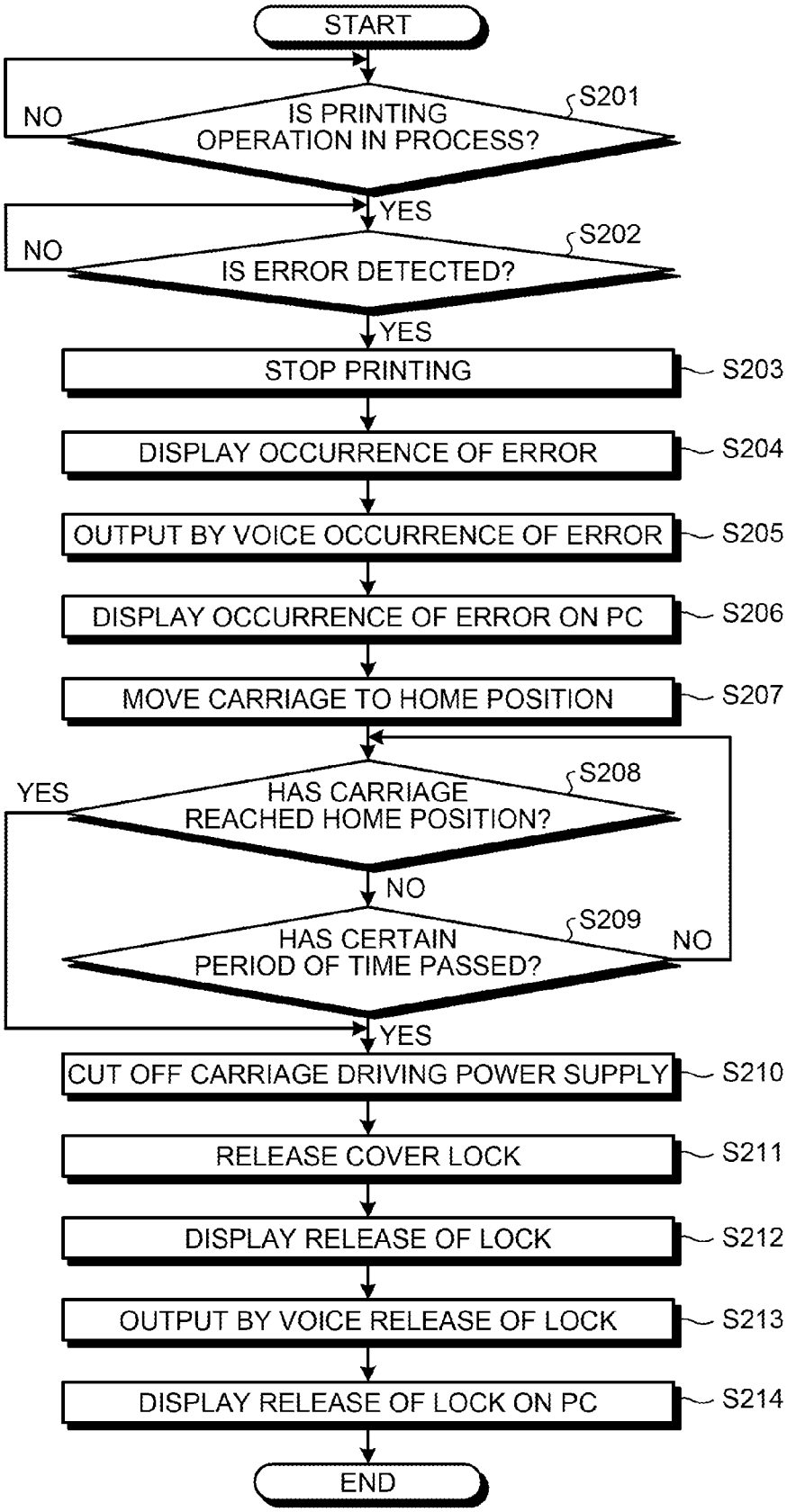
FIG. 7 is a flowchart illustrating control procedures by a system control unit after an error occurred during printing.

FIG. 7 is a flowchart illustrating control procedures by the system control unit 101 after an error occurred during printing.

The control procedures after an error occurred during printing are as follows.

When an error detecting unit 119 detects that an operation error occurs (Yes at Step S202) during printing (Yes at Step S201), the carriage power control unit 101*b* of the system control unit 101 immediately stops the printing operation (Step S203), and displays, on the display unit 105, a message that the error has occurred (Step S204). The carriage power control unit 101*b* also outputs by voice the message that the error has occurred from the voice output unit 106 (Step S205). Moreover, the carriage power control unit 101*b* accesses a personal computer (PC) through a network from the network I/F 107, and displays, on a screen of the PC, the message that the error has occurred (Step S206). Then, the carriage power control unit 101*b* moves the carriage 5 to its home position (Step S207).

Here, the main-scanning position detecting unit 114 detects whether the carriage 5 has reached its home position (Step S208). Once a certain period of time has passed (Yes at Step S209) without the carriage 5 reaching its home position (No at Step S208), the carriage power control unit 101*b* determines that the carriage 5 is unable to move due to some obstacle such as a recording sheet. The fact that the carriage 5 is in an immovable state may be determined based on the detection of a carriage moving load by the carriage load detecting unit 113.

The carriage load detecting unit 113 and the main-scanning position detecting unit 114 may be collectively referred to as an "immovability detecting unit".

When the carriage power control unit 101*b* detects that the carriage 5 is unable to move, it turns off the carriage driving power supplying switch 109 to open the power supplying path to the carriage driving unit 108, thus cutting off the power supply to the carriage driving unit 108 (Step S210). Then, the lock control unit 101*a* controls the cover lock unit 115 to release the lock of the cover 30 by the cover lock unit 115 (Step S211), so that the cover 30 can be opened.

After the cover 30 is released, the carriage power control unit 101*b* displays, on the display unit 105, a message that the cover 30 can be opened and closed (Step S212). The carriage power control unit 101*b* also outputs by voice the message that the cover 30 can be opened and closed from the voice output unit 106 (Step S213). Moreover, the carriage power control unit 101*b* accesses a PC through a network from the network I/F 107 to display, on a screen of the PC, the massage that the cover 30 can be opened and closed (Step S214).

Figure 8:
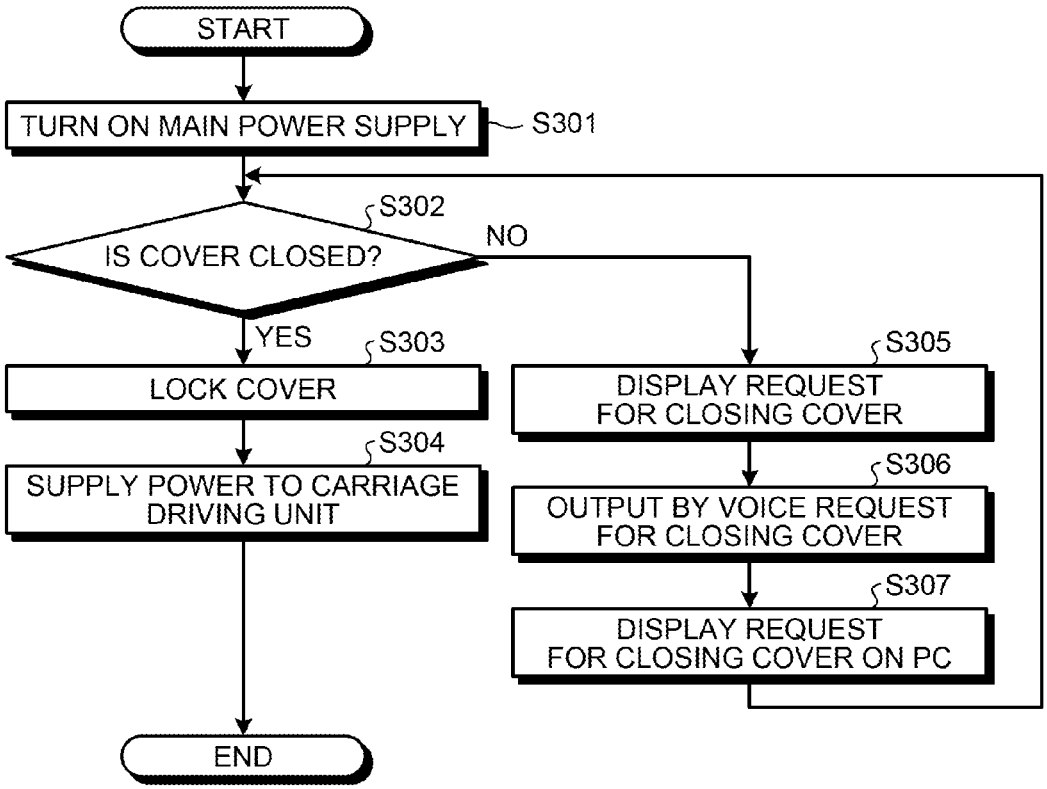

FIG. 8 is a flowchart illustrating control procedures performed by the system control unit 101 when the main power supply is turned on.

The control procedures by the system control unit 101 when the main power supply is turned on are described with reference to FIG. 8. First, when the main power supply is turned on (Step S301), the cover opening/closing detecting unit 120 detects whether the cover 30 is closed (Step S302). Here, if the cover 30 is closed (Yes at Step S302), the lock control unit 101*a* controls the cover lock unit 115 to lock the cover 30 in the main housing (Step S303). After the cover 30 is locked, the carriage power control unit 101*b* turns on the carriage driving power supplying switch 109 to supply power to the carriage driving unit 108 (Step S304), thus enabling the carriage to be driven.

When the cover 30 is open (No at Step S302) at Step S302, the carriage power control unit 101*b* displays, on the display unit 105, contents for requesting the closing of the cover so that the cover 30 is closed (Step S305). The carriage power control unit 101*b* also outputs by voice contents for requesting the closing of the cover 30 from the voice output unit 106 (Step S306). Moreover, the carriage power control unit 101*b* accesses a PC through a network from the network I/F 107 to display, on a screen of the PC, contents for requesting the closing of the cover 30 (Step S307).

Figure 9:
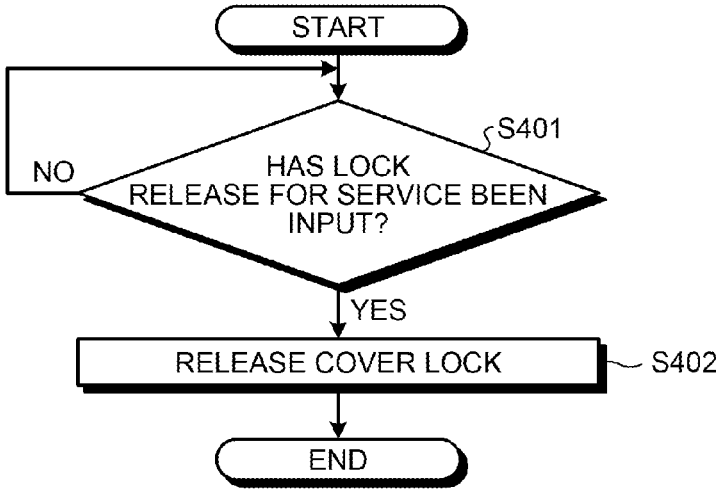
FIG. 9 is a flowchart illustrating control procedures by the system control unit when maintenance service is provided.

FIG. 9 is a flowchart illustrating control procedures by the system control unit 101 when maintenance service is provided.

The control procedures when maintenance service is provided are described with reference to FIG. 9.

A service person for maintenance service of the inkjet recording device cannot perform operation while the cover 30 is closed. Therefore, operation for releasing the cover 30 is necessary. Then, an operation mode exclusive for a service person is preliminarily registered in the inkjet recording device. In this manner, once operation in the operation mode exclusive for a service person is performed through the operating unit 104, the service person can perform operation. When the input of releasing the lock for service to the operating unit 104 by the service person is detected (Yes at Step S401), the lock control unit 101*a* immediately controls the cover lock unit 115 to release the lock of the cover 30 by the cover lock unit 115 (Step S402).

In this case, the interlock switch 116 is turned off once the cover 30 is opened. Thus, the power supply to the carriage driving unit 108 is cut off, and the carriage in motion is stopped. The carriage power control unit 101*b* also temporarily stops printing.

In the above description, the procedures of display, etc., at Steps S204 to S206, S212 to S214, S305 to S307 are sequentially performed. However, it is obviously possible to arrange them so that only one or two of such Steps are performed.

As described above, in the embodiment, the lock control unit 101*a* and the carriage power control unit 101*b* of the system control unit 101 cooperate with each other to control carriage operation and the cover lock unit, which makes it possible to obtain sufficient safety in any case while preventing the carriage from moving when the cover is opened. After the cover is opened, the carriage driving power supply is not turned on unless the cover is closed and locked to the body housing. This avoids any case where a moving carriage hits a hand inserted in the device.

According to the embodiment, it allows an operator to safely use an inkjet recording device that is excellent in safety without a risk of injury due to the movement of the carriage because the power supply to the carriage driving unit is always set to be open every time the operator releases the cover lock to open the cover.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An inkjet recording device comprising:

a carriage including a print head for recording by firing an ink droplet onto a recording medium from a nozzle;

a carriage driving unit configured to drive the carriage;

an operable cover configured to cover a moving area of the carriage;

a cover lock member configured to lock the cover to a housing of the inkjet recording device;

a lock control unit configured to control a lock of the cover and release of the lock of the cover by the cover lock member;

a lock releasing unit configured to request the lock control unit to release the lock of the cover; and a carriage power control unit configured to control opening and closing of a power supplying path to the carriage driving unit, wherein the lock control unit causes the cover lock member to release the lock of the cover if the lock releasing unit is operated and the carriage power control unit opens the power supplying path to the carriage driving unit.

2. The inkjet recording device according to claim 1, wherein when the lock releasing unit is operated during printing operation, the carriage power control unit stops the printing operation, the carriage power control unit receives an instruction of continuation or cancellation of image printing while the printing operation is stopped, when cancellation of the image printing is instructed, the carriage power control unit forcibly discharges a sheet on which an image is being printed, when continuation of the image printing is instructed, the carriage power control unit restarts the printing operation, and after print output is finished, the carriage power control unit causes the carriage driving unit to move the carriage to a home position.

3. The inkjet recording device according to claim 1, wherein when an error occurred during printing, the carriage power control unit displays, on a display unit, a message that the error has occurred, outputs the message by voice from a voice output unit, or displays the message on a screen of a terminal device connected to the inkjet recording device through a network, and causes the carriage driving unit to move the carriage to a home position.

4. The inkjet recording device according to claim 3, further comprising:

an immovability detecting unit configured to detect that the carriage cannot move, on a way of the carriage to a home position caused due to occurrence of the error during printing, wherein when the immovability detecting unit detects that the carriage cannot move, the carriage power control unit opens the power supplying path to the carriage driving unit.

5. The inkjet recording device according to claim 1, wherein, when the cover lock member is released, a message that the cover lock member is released is displayed on a display unit, output by voice from a voice output unit, or displayed on a screen of a terminal device connected through a network.

6. The inkjet recording device according to claim 1, further comprising an interlock switch configured to open the power supplying path to the carriage driving unit when the cover is opened.

7. The inkjet recording device according to claim 1, wherein the lock control unit causes the cover lock member to lock the cover if a main power supply of the inkjet recording device is on and the cover is closed.

8. The inkjet recording device according to claim 7, wherein the carriage power control unit closes the power supplying path to the carriage driving unit if the cover lock member locks the cover.

9. The inkjet recording device according to claim 1, wherein when a main power supply of the inkjet recording device is turned on, the opening of the cover is detected, and a message that the cover is opened is displayed on a display unit, output by voice from a voice output unit, or displayed on a screen of a terminal device connected through a network.

10. The inkjet recording device according to claim 1, wherein the lock releasing unit is operated in accordance with predetermined specific operation on an operating unit.

11. A method of releasing a cover lock of an inkjet recording device that includes a carriage including a print head for recording by firing an ink droplet onto a recording medium from a nozzle, a carriage driving unit configured to drive the carriage, an operable cover configured to cover a moving area of the carriage, a cover lock member configured to lock the cover to a housing of the inkjet recording device, a lock control unit configured to control lock of the cover and release of the lock of the cover by the cover lock member, a lock releasing unit configured to request the lock control unit to release the lock of the cover, and a carriage power control unit configured to control opening and closing of a power supplying path to the carriage driving unit, the method comprising a step of:

causing, by the lock control unit, the cover lock member to release the lock of the cover if the lock releasing unit is operated and the carriage power control unit opens the power supplying path to the carriage driving unit.

* * * * *